United States Patent [19]

Hernqvist

[11] Patent Number: 4,515,569

[45] Date of Patent: May 7, 1985

[54] METHOD OF ELECTRICALLY PROCESSING A CRT MOUNT ASSEMBLY TO REDUCE ARCING AND AFTERGLOW

[75] Inventor: Karl G. Hernqvist, Princeton, N.J.

[73] Assignee: RCA Corporation, Princeton, N.J.

[21] Appl. No.: 487,462

[22] Filed: Apr. 22, 1983

[51] Int. Cl.[3] ..... H01J 9/20

[52] U.S. Cl. ..... 445/5; 445/6

[58] Field of Search ..... 445/5, 6, 17, 19, 57

[56] References Cited

U.S. PATENT DOCUMENTS

| | | | |
|---|---|---|---|
| 3,321,263 | 5/1967 | O'Fallon | 316/18 |
| 3,966,287 | 6/1976 | Liller | 316/1 |
| 4,018,489 | 4/1977 | Miller | 445/17 |
| 4,052,776 | 10/1977 | Maskell et al. | 29/25.11 |
| 4,214,798 | 7/1980 | Hopen | 316/26 |
| 4,326,762 | 4/1982 | Hockenbrock et al. | 316/1 |
| 4,395,242 | 7/1983 | Liller | 445/5 |
| 4,406,637 | 9/1983 | Hernqvist | 445/6 |
| 4,407,657 | 10/1983 | Fransen | 445/17 |
| 4,410,310 | 10/1983 | Halbrook | 445/6 |

FOREIGN PATENT DOCUMENTS

| | | | |
|---|---|---|---|
| 126457 | 10/1979 | Japan | 445/5 |
| 143751 | 11/1980 | Japan | 445/6 |

OTHER PUBLICATIONS

RCA Technical Notes, TN No. 1236, by P. R. Liller et al., entitled, "Method for Reducing Electron Emission from Control Grid of a Cathode-Ray Tube".

*Primary Examiner*—Kenneth J. Ramsey
*Assistant Examiner*—K. C. Rowan
*Attorney, Agent, or Firm*—Eugene M. Whitacre; Dennis H. Irlbeck; LeRoy Greenspan

[57] ABSTRACT

The novel method of electrically processing a completed and operative CRT comprises (A) heating the portions of the focus electrode that face a high-voltage electrode at temperatures above about 700° C. and simultaneously (B) spot-knocking the heated portions of the focus electrode. The novel method can be applied during the initial processing of the CRT and/or subsequently during a reprocessing procedure.

7 Claims, 1 Drawing Figure

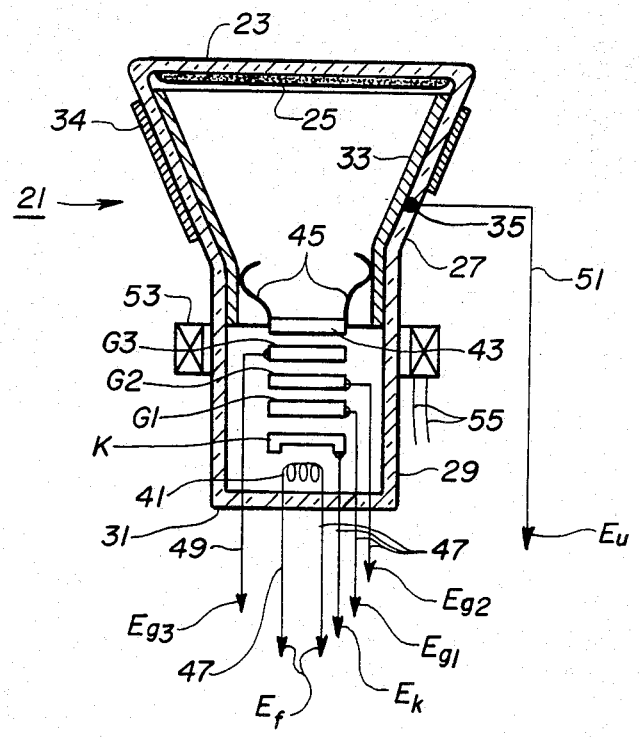
23
25
34
33
21
35
45
27
51
53
G3
43
G2
G1
55
K
29
41
31
49
47
Eu
Eg2
Eg3
Eg1
47
Ef
Ek

METHOD OF ELECTRICALLY PROCESSING A CRT MOUNT ASSEMBLY TO REDUCE ARCING AND AFTERGLOW

BACKGROUND OF THE INVENTION

This invention relates to a novel method of electrically processing a completely-assembled CRT (cathode-ray tube) to reduce, and preferably to completely suppress, both arcing and afterglow during and after the subsequent operation of the CRT.

A CRT comprises an evacuated envelope which includes a neck, a funnel and a faceplate opposite the neck. A luminescent viewing screen is supported on the internal surface of the faceplate. A conductive coating on the inside of the funnel is one plate of a filter capacitor, and also is the anode of the CRT. An external coating on the funnel is the other plate of the filter capacitor. A mount assembly including one or more electron guns is supported from a glass stem that is sealed into the neck. Each electron gun includes a cathode, a control electrode, a screen electrode, a focus electrode and a high-voltage electrode.

After the CRT is completely assembled, evacuated and sealed, the mount assembly is electrically processed so that the electron gun or guns become operative, their operation stabilized and their operating lives lengthened. This processing includes (i) "hot-shot" wherein the cathodes are rendered electron emitting, (ii) "low-voltage aging" wherein the electron emissions are stabilized and (iii) "spot-knocking" wherein arcing and stray electron emission from the electrodes during operation are reduced, afterglow is reduced or completely suppressed and the operation of the CRT is further stabilized.

Afterglow is the effect wherein a completed CRT, installed in a chassis and operated in a normal manner, may continue to emit light from the viewing screen after the normal operating voltages are removed from the mount assembly. This effect, which may linger for minutes or hours, is attributed to the coincidence of: (1) a residual high voltage on the anode of the CRT and on the high-voltage electrodes of the mount assembly with respect to the other electrodes of the mount assembly, and (2) sites on the electrodes of the electron gun from which electrons can be emitted when they are under the influence of the electric field produced by the residual high voltage on the high-voltage electrodes. Emitted electrons under the influence of the electric field move toward, and impinge upon, the viewing screen producing the afterglow.

Spot-knocking may be conducted before or after the hot-shot. In ordinary spot-knocking, all of the gun elements that are not connected to the anode are connected to ground potential, and positive voltages of sufficient magnitude are applied to the anode, causing arcing to occur between gun elements connected to the anode and the adjacent gun elements. The positive voltages may be varying DC voltages, such as clamped AC or rectified AC. The positive voltages may be pulses obtained by capacitive discharge through a ball gap. Where varying DC voltages are employed, RF (radio frequency) pulses may be imposed on the varying DC voltages. In every case, spot-knocking has the effect of producing arcs which burn particles and microprotrusions from the surfaces of the electrodes. If the arc currents are high enough and properly located, substantially all of the particles and protrusions will be vaporized or fused, and few free particles will be produced. If the current is not high enough and/or is not properly located, remnants will remain which are sites for stray electron emissions in the presence of electric fields. If the arc current is too high, an unacceptable amount of particles will be generated, which particles may interfere with the subsequent operation of the CRT, including being a cause of arcing and/or afterglow.

In one prior method of electrically processing a CRT, disclosed in U.S Pat. No. 4,395,242 to P. R. Liller et al. and referred to herein as SERP, the portion of the focus electrode facing the high-voltage electrode is heated at temperatures above about 700° C. prior to RF spot knocking (RFSK); that is, spot-knocking the electrodes with high varying DC voltages having high-intensity RF pulses superimposed thereon. Heating is preferably achieved by bombarding the focus electrode with electrons from the cathode of the CRT. Where this prior method is applied to a tube that is receiving its initial electrical processing, the heating step is conducted during the low-voltage aging step, and the RFSK is applied after the IIP structure is mounted on the CRT, as in prior practice. Where the novel method is applied to tubes that were rejected for excessive afterglow; that is, the tubes are being reprocessed, the heating step is conducted and then is followed by the additional step of RF spot-knocking. While this prior SERP method is successful with most tubes, there is a small percentage of tubes that exhibit unacceptable afterglow even after several cycles of this prior method. Also, because of the severity of this prior method, undesirable particles may be generated which may interfere with the proper operation of many tubes.

SUMMARY OF THE INVENTION

The novel method of electrically processing a completed CRT comprises (A) heating portions of the focus electrode of the CRT that face the high-voltage electrode at temperatures above about 700° C. and simultaneously (B) spot-knocking the heated portions of the focus electrode. The novel method may be applied to the electron gun of any CRT. The focus electrode of the CRT is preferably heated by radio-frequency induction. The novel method may be practiced advantageously at any time after the CRT is sealed including during reprocessing, if that is necessary.

BRIEF DESCRIPTION OF THE DRAWING

The sole FIGURE is a schematic representation of a CRT and an associated circuit arrangement for practicing the novel method.

DETAILED DESCRIPTION OF THE PREFERRED EMBODIMENTS

The novel method may be applied to any electron gun having a cathode and four or more electrodes at least two of which are biased independently of one another for focusing an electron beam. There may be a single gun or a plurality of guns in the electron-gun mount of the cathode-ray tube. Where there is more than one gun in the mount, the guns may be in any geometric arrangement. Where there are three guns, as in a color television picture tube, for example, the guns may be arranged in a delta array, or in an in-line array, or in any other array.

The novel method may be applied, for example, to bipotential and tripotential electron-gun structures. A bipotential gun structure typically has a cathode heater and cathode K, a control electrode G1, a screen electrode G2, a single focus electrode G3 and a high-voltage electrode, which is often designated as the anode electrode or G4. Although separate elements may be provided for each of the three electron guns of a color picture tube, recent practice has tended to use common elements for G1, G2, G3 and G4 for the three electron guns. A tripotential gun differs from a bipotential in that it employs three focus electrodes for the focusing action instead of only one. A tripotential gun typically has a cathode heater, a cathode K, a control electrode G1, a screen electrode G2, three focus electrodes G3, G4, and G5, and a high-voltage electrode, which is often designated G6. The new procedures generally will be explained principally as they relate to a bipotential gun structure. For the tripotential gun structure, the focus electrodes G3 and G5 are electrically connected, and the G2 and G4 electrodes are electrically connected when the novel method is being practiced. The G3 and G5 electrodes may be processed by the novel method at the same time, or sequentially, or only one of them may be processed by the novel method.

Cathode-ray tubes may be processed according to the novel method in a succession of stations having equipments which can apply, for the various processing steps, programs of voltages to the cathode and the various electrodes of each electron gun in the CRT. The CRT may be transported by hand or on a conveyor from station to station as is known in the art. Suitable conveyors are described in U.S. Pat. No. 2,917,357 to T. E. Nash and U.S. Pat. No. 3,698,786 to Edward T. Gronka. The novel method will be exemplified now on a tube that is transported by hand. At each station, the tube is placed in a holder therefor, and a socket is connected to the base pins of the CRT.

The general sequence of steps for processing a completely-assembled CRT includes pre-age spot-knocking, then hot-shot, then low-voltage aging. Then, optionally, there may be another step of spot-knocking. An integral implosion protection structure may then be assembled to the CRT. Then, there is the novel step of heating with simultaneous spot-knocking. Since all of the foregoing steps, except the novel step, are well described in the prior art, no further detailed description will be made herein. Embodiments of the novel method will now be described with respect to the sole FIGURE.

The sole FIGURE includes a schematic, sectional, elevational view of a CRT 21 including a faceplate panel 23 carrying on its inner surface a luminescent viewing screen 25. The panel 23 is sealed to the larger end of a funnel 27 having a neck 29 integral with the smaller end of the funnel 27. The neck 29 is closed by a stem 31. The inner surface of the funnel 27 carries an internal conductive coating 33 which contacts an anode button 35. The outer surface of the funnel carries an external conductive coating 34.

The neck 29 houses a bipotential electron-gun mount assembly such as the mount assembly described in U.S. Pat. No. 3,772,554 to R. H. Hughes. This assembly includes three bipotential guns, only one of which is illustrated in the sole FIGURE. The mount assembly includes two glass support rods (not shown) from which the various gun elements are mounted. The gun elements of each gun include a cathode heater 41, a cathode K, a control electrode G1, a screen electrode G2, a focusing electrode G3 and a high-voltage electrode 43. The high-voltage electrode 43 is connected to the internal conductive coating or anode 33 with snubbers 45. The heater 41, the cathode K, the control electrode G1, and the screen electrode G2, which are referred to herein as the lower-voltage gun elements, are connected to separate stem leads 47 which extend through the stem 31. The focus electrode G3 is connected to a separate G3 lead 49 which extends through the stem 31. The anode button 35 is connected to a separate anode lead 51. An induction coil 53 comprising three turns of solid copper ribbon is connected through coil leads 55 to a source of radio-frequency power of about 300 kilohertz through a switch (not shown). The induction coil 53 is positioned opposite the G3 electrode so that the portions of the G3 electrode facing the G4 electrode are heated by induction when the coil 53 is energized.

During the electrical processing of a completed (evacuated and sealed) CRT, the stem leads 47 are inserted into a socket (not shown), and each lead is connected to a separate voltage source (not shown). The mount assembly is subject to a program of voltages which are applied through the leads 47 in which the following nomenclature is used:

$E_f$ is the voltage applied across the cathode heater 41,
$E_k$ is the voltage applied to the cathode K,
$E_{g1}$ is the voltage applied to the control electrode G1,
$E_{g2}$ is the voltage applied to the screen electrode G2,
$E_{g3}$ is the voltage applied to the focusing electrode G3,
$E_u$ is the voltage applied to the high-voltage electrode G4 through the connection to the internal conductive funnel coating 33 and the anode button 35, and
$E_h$ is the voltage applied to the coil 53.

The novel method is exemplified below in two examples. In Example 1, the tube is being initially processed according to the novel method. In Example 2, a tube that has been rejected for exhibiting excessive afterglow is being reprocessed according to the novel method. In each example, a tube is transported by hand to a holder where a socket (not shown) is connected to the base pins or leads of the tube. In Example 1, the holder is on a conveyor as described above. In Example 2, the holder is one of sixteen holders in a reprocessing apparatus.

EXAMPLE 1

Initial Processing Procedure

Step 1—Preage Spot-Knocking—The cathode, the heater and the G1, G2 and G3 electrodes are electrically connected together and grounded. The G4 or high-voltage electrode 43 is connected to a source which supplies a train of pulses of positive voltage through the anode button 35. The pulses rise from ground potential initially to plus 35±5 kilovolts, increasing linearly to plus 60±5 kilovolts in 90 to 120 seconds. Each successive pulse is comprised of an ac voltage peaking at a higher value and having a frequency of 60 hertz. The negative portion of the ac voltage is clamped to ground potential. The duration of the pulses may be in the range of 0.1 to 0.2 second (6 to 12 cycles), and the spacing of the pulses may be in the range of 0.5 to 1.0 second.

Step 2—Cathode Conversion—Apply $E_f$=9.3±0.5 volts for about 60 seconds. All other elements are electrically floating.

Step 3—Hotshot—Apply $E_f=11.2\pm0.5$ volts for 90 to 120 seconds. All other elements are electrically floating.

Step 4—Low Voltage Aging and Heating by Electron Bombardment—Apply $E_f=9.2\pm0.4$ volts, $E_k=0$, $E_{g1}=0$. Eu is electrically floating, and $E_{g2}$ and $E_{g3}$ (approximate) are as follows for the indicated successive time periods in minutes:

| Time (minutes) | $E_{g2}$ (volts) | $E_{g3}$ (volts) |
|---|---|---|
| 1 | Floating | Floating |
| 55 | +375 | Floating or Ground |
| 5 | Floating | Floating |

Step 5—Post IIP Spot-Knocking—After the implosion-protection system is assembled to the CRT, a spot-knocking procedure by the novel method is applied as follows. The cathode, the heater and the G1, G2 and G3 are connected to ground. The high-voltage electrode 43 is connected to a low-frequency source which supplies a train of 60-hertz positive half-wave pulses through the anode button 35. The 60-hertz pulses rise from ground potential initially to plus $45\pm10$ kilovolts and are applied for about 2 minutes. Simultaneously, RF power is applied to the induction coil 53 through the coil leads 55 causing the portions of G3 to rise to temperatures above about 700° C., and believed to be about 800° C. from visual inspection. The simultaneous application of heat and spot-knocking voltages is continued for about two minutes, although they may be applied simultaneously for about 1 to 5 minutes. Optionally, the G3 electrode may be floating electrically instead of being grounded.

Step 6—Final Cathode Aging—Apply $E_f=9.3\pm0.5$ volts dc for about 5 minutes. All other elements are electrically floating.

TESTING FOR AFTERGLOW

An operative CRT may be tested for afterglow with the following procedure, which is conducted in a darkened room. All of the electrodes of the CRT are grounded except for the anode. The anode voltage is increased until some portion of the viewing screen is excited to luminescence as viewed with the human eye. Only a localized area need light up, and the area may differ for different tubes. Then, the anode voltage is slowly reduced until all luminescence of the screen just disappears. The anode voltage at which this occurs is called the extinction voltage or $E_{ext}$. The $E_{ext}$ for a particular CRT is compared with a known threshold extinction voltage and the tube is rejected if $E_{ext}$ is below this threshold, or accepted if $E_{ext}$ is at or above this threshold. The threshold extinction voltage always has a value between the operating anode voltage (Eu) of the CRT and the difference between the operating anode voltage and the operating focus voltage ($Eu-E_{g3}$). For an acceptable tube including the in-line mount assembly shown in the sole FIGURE above, $E_{ext}Eu-E_{g3}>30-7$ kv$>23$ kv, approximately.

EXAMPLE 2

Reprocessing Procedure

Step 1—Spot Knocking—Follow step 5 of Example 1.

Step 2—Final Cathode Aging—Apply $E_f=9.3\pm0.5$ volts for about 5 minutes. All other elements are floating.

GENERAL CONSIDERATIONS

The novel method reduces the flow of field-emission electrons which impinge upon the viewing screen of a color picture tube and produce a phenomenon referred to as stray emission, or when visible on the screen after the receiver is turned off, afterglow. Stray emission is a defect in which field-emission electrons, generally from the focus electrode, are attracted to the screen and compete with the well-controlled therionic electron beams from the three electron guns in forming the desired image on the screen. If the level of the current causing the stray emission is too high, of the order of microamperes, the picture quality is adversely affected by blemishes (screen lighting) created by the undesired stray-emission electrons. In practically all well-designed modern picture tubes, the electrical processing of the tube is adequate to limit the stray emission to values which will not blemish the picture under standard scanning conditions.

The stray emission does become a problem, however, in some types of television receivers which do not provide for reduction of the anode voltage by means of a bleeder resistance upon receiver shutdown. In many of the receivers of this type, when the receiver is turned off after operation, the anode voltage remains at relatively high levels while the focus-electrode potential is reduced to ground level. This creates a situation in which the potential gradient between the high-voltage electrode and the focus electrode can be higher than it is during normal operating conditions. Since the screen is unscanned during receiver shutdown, relatively small currents, of the order of tens of nanoamperes, can form quite noticeable patterns on the screen which may persist for long time periods. Screen illumination produced by stray emission under these conditions is referred to as afterglow, a phenomenon which can be of great annoyance to persons near the receiver.

Stray emission may be produced by minute projections on the top surface of the focus electrode. As indicated above, stray emission is usually restricted to relatively low current levels by high-voltage processing, which is designed to erode the initial emission sites. This processing is not adequate by itself to process all tubes to be free from afterglow, even after the tubes have been subjected to many cycles of electrical processing.

The novel method for minimizing the incidence of afterglow comprises spot-knocking and simultaneously heating the portion of the focus electrode most likely to generate field emission sites; and that is the top of the focus electrode and, specifically, the surface immediately adjacent to and facing the high-voltage electrode. The novel method is sustained for a sufficient period, usually about 1 to 5 minutes, to insure that most incipient emission sites are removed. The strategy minimizes the probability that additional sites will emerge during subsequent spot-knocking.

Neither the heating of the focus electrode nor the spot-knocking is considered novel; both are well known processes that have been employed previously in tube manufacture. The invention lies in the discovery that heating of the focus electrode simultaneously with spot-knocking of the focus electrode will promote a condition where the number and efficiency of field emission sites are reduced substantially and where the probability of the formation of new field-emission sites is minimal. In some prior methods, considerable efforts were expended in minimizing the heating of the focus electrode in order to restrict the formation of new field-emission sites. The new method promotes this heating at even higher temperatures so that field-emission from sites on the electrode is increased, such that there is adequate current for the fusion and/or vaporization of the sites. The increase is achieved by assisting the spot-knocking with thermionic emission. At the heating temperatures, low work-function materials (such as barium, sodium, calcium, etc.) are present on the surfaces of electrodes, which further increases thermionic emission. Thus, the combination high temperature and lower work function causes a substantial increase in thermionic current which, added to field-emission currents, produces more complete removal of the emission sites without generating undesirable particles. Another important additional benefit of heating is to drive off low-work-function materials on the focus electrode which contribute to the intensity of the stray emission.

In one comparative test, one group of tubes was net afterglow scrap which had gone through RFSK four times and also the SERP process. The second group of tubes was gross afterglow scrap with no SERP processing. Measurements of the extinction voltages were done initially, after simultaneous heating and spot-knocking by the novel method, and after final RFSK. The results show that the novel method is by far the most effective way of reducing net afterglow scrap. The basic physical processes are not well understood, and this process may offer possibilities of reducing arcing and stray emission with less-damaging consequences for the tube.

What is claimed is:

1. In a method of electrically processing a completed CRT having an electron gun including a focus electrode and a high-voltage electrode, said high-voltage electrode being closely spaced from said focus electrode, the steps comprising (A) heating portions of said focus electrode that face said high-voltage electrode at temperatures above about 700° C. and simultaneously (B) spot-knocking said heated portions of said focus electrode.

2. The method defined in claim 1 wherein steps (A) and (B) are carried out before an integral implosion protection structure is mounted on said CRT.

3. The method defined in claim 1 wherein said steps (A) and (B) are carried out after an integral implosion protection structure is mounted on said CRT.

4. The method defined in claim 1 wherein said steps (A) and (B) are continued simultaneously for about 1 to 5 minutes.

5. The method defined in claim 1 wherein said heating step is achieved by magnetic induction.

6. The method defined in claim 5 wherein said heating step (A) includes applying magnetic fields at radio frequencies.

7. The method defined in claim 1 wherein said spot-knocking step includes applying clamped AC spot-knocking voltages.

* * * * *